US007896097B2

(12) United States Patent
Teng

(10) Patent No.: US 7,896,097 B2
(45) Date of Patent: Mar. 1, 2011

(54) ELECTRIC POWER TOOL

(75) Inventor: Cheng-I Teng, Taichung County (TW)

(73) Assignee: Mobiletron Electronics Co., Ltd, Taya Hsiang, Taichung Hsien (TW)

( * ) Notice: Subject to any disclaimer, the term of this patent is extended or adjusted under 35 U.S.C. 154(b) by 188 days.

(21) Appl. No.: 12/362,816

(22) Filed: Jan. 30, 2009

(65) Prior Publication Data

US 2010/0193206 A1 Aug. 5, 2010

(51) Int. Cl.
*B25D 11/06* (2006.01)
*B25D 16/00* (2006.01)

(52) U.S. Cl. ..... 173/48; 173/178; 173/216

(58) Field of Classification Search ..... 173/48, 173/178, 216, 176, 104, 109
See application file for complete search history.

(56) References Cited

U.S. PATENT DOCUMENTS 5,711,380 A * 1/1998 Chen ..... 173/48
6,142,242 A * 11/2000 Okumura et al. ..... 173/48
7,308,948 B2 * 12/2007 Furuta ..... 173/48
7,455,615 B2 * 11/2008 Chen ..... 475/300
2005/0199404 A1 * 9/2005 Furuta et al. ..... 173/48
2006/0086514 A1 * 4/2006 Aeberhard ..... 173/48
2007/0056756 A1 * 3/2007 Chung et al. ..... 173/48
2007/0181319 A1 * 8/2007 Whitmine et al. ..... 173/48
2007/0201748 A1 * 8/2007 Bixler et al. ..... 382/225
2008/0161150 A1 * 7/2008 Hagan et al. ..... 475/298
2008/0167158 A1 * 7/2008 Chen ..... 475/298
2010/0193206 A1 * 8/2010 Teng ..... 173/48

* cited by examiner

*Primary Examiner*—Paul R Durand
(74) *Attorney, Agent, or Firm*—Browdy and Neimark, PLLC

(57) ABSTRACT

An electric power tool includes a planetary gear reduction mechanism, a switch mechanism, an impact mechanism, a hammer mechanism, a torque fixing mechanism, and a torque adjusting mechanism. The switch mechanism includes a driving member, a first driven member, and a second driven member. A switching member is provided on the electric power tool and connected to the driving member to move it, and the driving member may drive the first driven member and the second driven member respectively to start or shut the impact mechanism and the hammer mechanism.

13 Claims, 11 Drawing Sheets

ELECTRIC POWER TOOL

BACKGROUND OF THE INVENTION

1. Field of the Invention

The present invention relates generally to a hand tool, and more particularly to an electric power tool capable of switching various operation modes by a single switch.

2. Description of the Related Art

Typically, a conventional electric power tool includes a motor, a planetary gear reduction mechanism, an impact mechanism, and a hammer mechanism. A shaft of the motor is connected to the planetary gear reduction mechanism to change the speed thereof, and the impact mechanism is connected to the planetary gear reduction mechanism. The conventional impact mechanism includes a shaft and an impact member. The shaft is driven by the planetary gear reduction mechanism. The shaft has slots thereon, in which balls are received. The impact member is fitted to the shaft through the balls. The impact member has two blocks on a top thereof. A spindle, which is connected to the shaft of the impact mechanism, has two arms interacted with the blocks of the impact member. In a normal condition, the shaft will drive the impact member and the spindle rotation together. Under a condition of a resistance on the spindle, the impact member will be reciprocated by the interaction of the blocks of the impact member and the arms of the spindle that the impact member will generate an impact effect, and we call it as "impact mode". In the conventional electric power tool, a stopper is provided behind the impact member to stop the impact member moving backwards that no impact effect when the stopper behind the impact member. The stopper may be moved away to give a sufficient space behind the impact member that the impact member may provide impact effect. The detail structure and function of the impact mechanism are taught by U.S. Pat. No. 7,308,948.

Typically, the hammer mechanism is provided in front of the impact mechanism, which includes a first teeth disk and a second teeth disk, and the first teeth disk is fixed and the second teeth disk is free to rotate. The second teeth disk is connected to the spindle and rotated together with the spindle. A cam is provided behind the first teeth disk to move the first teeth disk to engage or disengage the second teeth disk. The hammer mechanism will generate a vibration effect when the teeth disks are engaged together. We call it as "hammer mode". The detail structure and function of the hammer mechanism is taught by U.S. Pat. No. 6,142,242.

When both of the impact mechanism and the hammer mechanism are shut, the spindle is rotating in a maximum power, and we call it as "drill mode". Recently, the electric power toll provides "driver mode". In "driver mode", the power is adjustable.

In the electric power toll of early time, there are two independent switches on the toll to control the impact mechanism and the hammer mechanism respectively. It is inconvenient to consumers. In recent time, however, there are electric power tool equipped with single switch to control all operation modes, for example U.S. Pat. No. 7,308,948. Because the stopper, which is the main device to switch "impact mode", and the cam, which is the main device to switch "hammer mode" are far away from each other that the switch to control both modes usually has a complex structure.

SUMMARY OF THE INVENTION

The primary objective of the present invention is to provide an electric power tool, which may switch various operation modes by one switch.

The secondary objective of the present invention is to provide an electric power tool, which provides fewer elements for impact mode and hammer mode.

The third objective of the present invention is to provide an electric power tool, which provides a novelty switch for driver mode.

According to the objectives of the present invention, an electric power tool includes a switching member provided on a housing of the electric power tool for manipulation; a driving member, which is connected to the switch member to be turned in a predetermined angle, having a first driving portion and a second driving member on a side; a first driven member having a driven portion directly engaged with the first driving portion of the driving member that a turn of the driving member moves the first driven member; a second driven member having a driven portion directly engaged with the second driving portion of the driving member that a turn of the driving member moves the second driven member; an impact mechanism having an impact member for reciprocation, wherein the first driven member is located behind the impact member; and a hammer mechanism having a first teeth ring and a second teeth ring, wherein the first teeth ring is provided on the second driven member, and the second teeth ring is connected to a spindle of the electric power tool.

The switching member is switchable to an impact mode, a hammer mode, and a drill mode. When the switching member is switched to the impact mode, the driving member moves the first driven member away from the impact member to start the impact mechanism, and the driving member also move the second driven member to disengage the second teeth ring with the first teeth ring to shut the hammer mechanism.

When the switching member is switched to the hammer mode, the driving member moves the first driven member toward the impact member to shut the impact mechanism, and the driving member also move the second driven member to engage the second teeth ring with the first teeth ring to start the hammer mechanism.

When the switching member is switched to the drill mode, the driving member moves the first driven member toward the impact member to shut the impact mechanism, and the driving member also move the second driven member to disengage the second teeth ring with the first teeth ring to shut the hammer mechanism.

For another objective of the present invention, the electric power tool includes a hammer mechanism and an impact mechanism. The impact mechanism has an impact member for reciprocation. The hammer mechanism has a first teeth ring and a second teeth ring, wherein the second teeth ring is provided on the impact member.

For the other objective of the present invention, the electric power tool includes a planetary gear reduction mechanism, which has a casing, in which a torque ring is mounted. A plurality of pins are inserted into the casing in association with a front end side of the torque ring. A driving member may push the pins to press the torque ring.

DETAILED DESCRIPTION OF THE INVENTION

Figure 1:
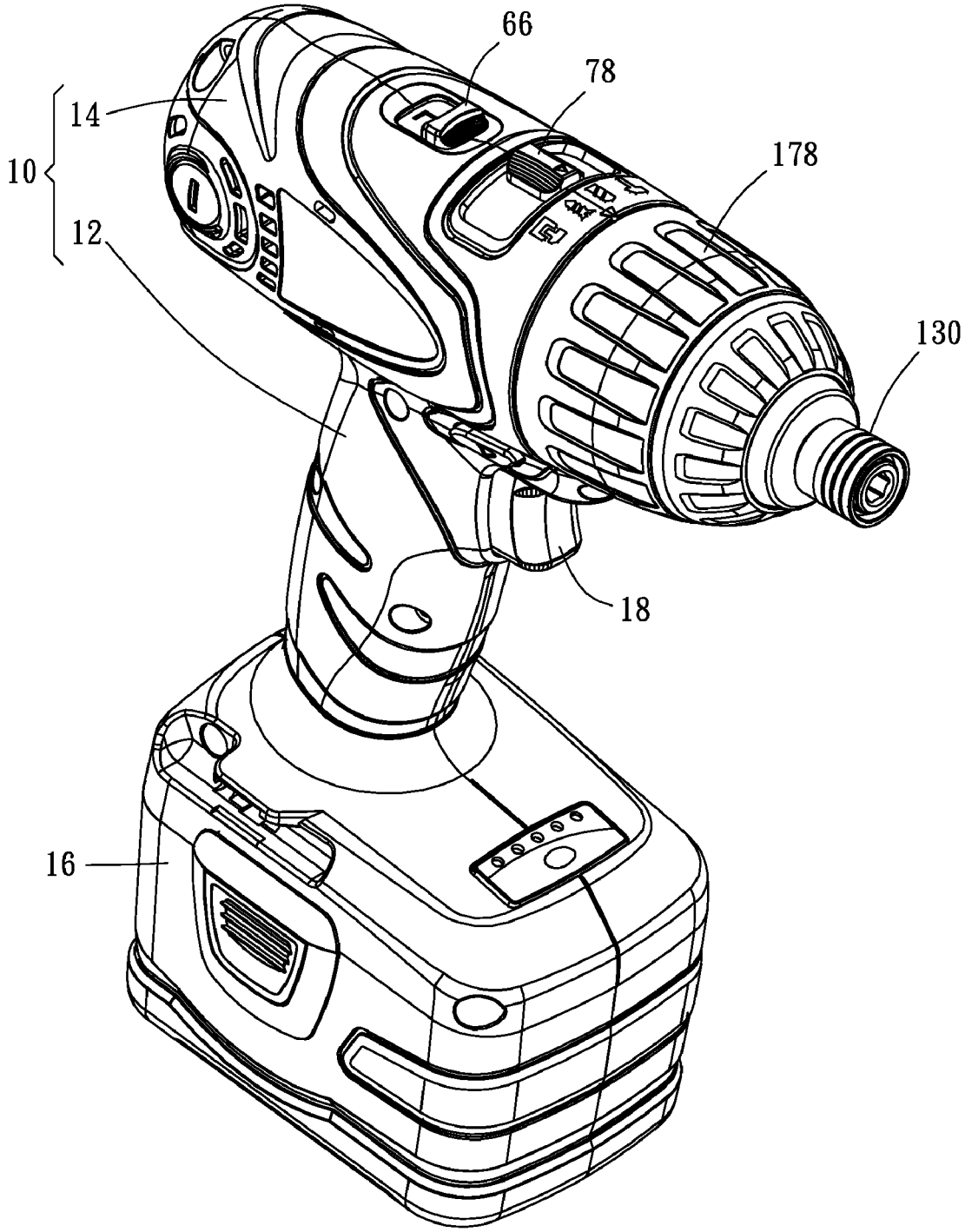
FIG. 1 is a perspective view of a preferred embodiment of the present invention.

As shown in FIG. 1 to FIG. 4, an electric power toll of the preferred embodiment of the present invention includes a housing 10. The housing 10 has a handle 12 and a machine room 14. A battery 16 is mounted on a bottom of the handle 12, and a trigger 18 is provided on the handle 12. In the machine room 14, a motor 20, a planetary gear reduction mechanism 26, a switch mechanism 70, an impact mechanism 120, a hammer mechanism 142, a torque fixing mechanism 148, and a torque adjusting mechanism 162 are provided.

Figure 4:
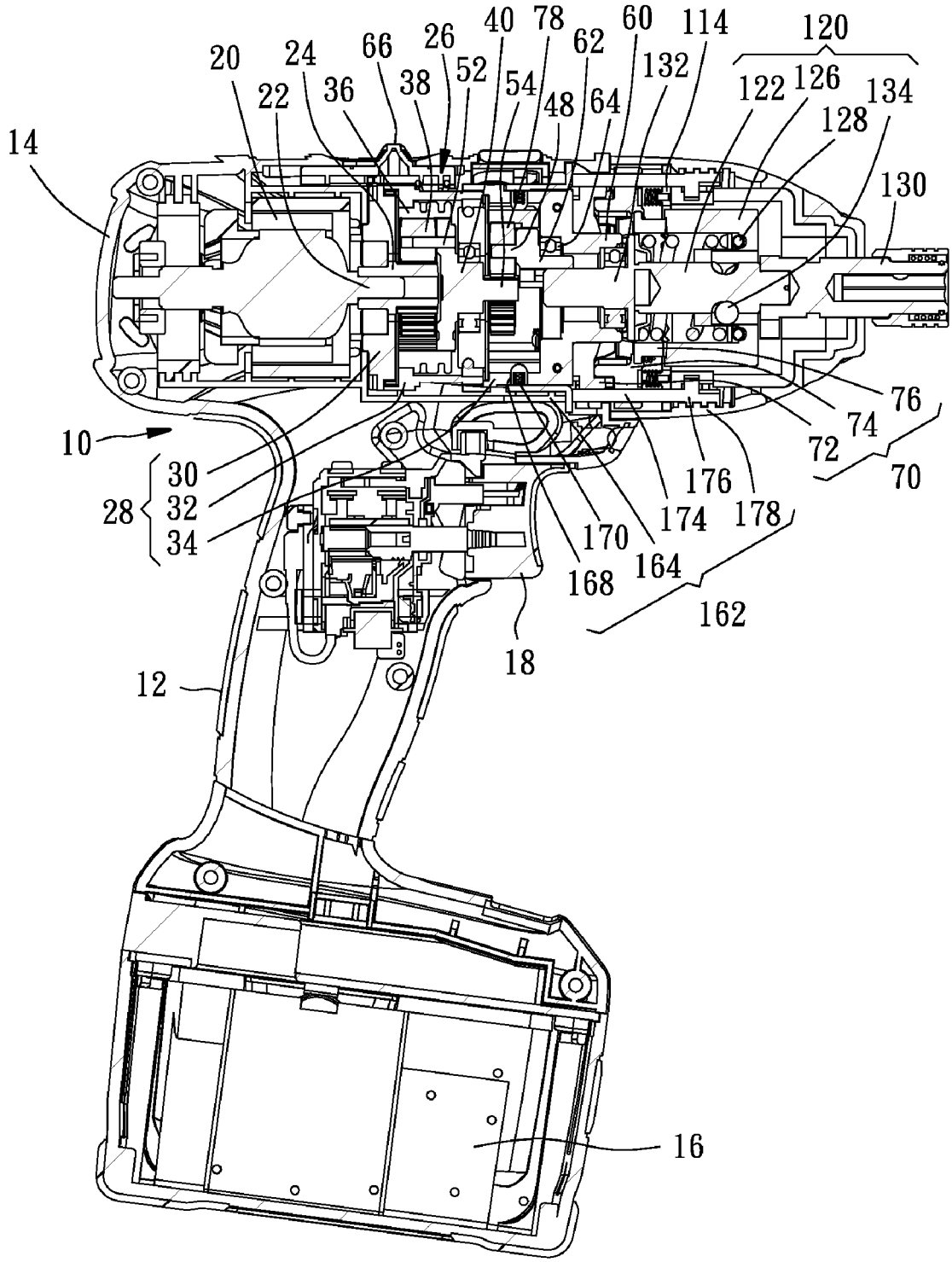
FIG. 4 is a sectional view of the preferred embodiment of the present invention.

As shown in FIG. 4, the motor 20 is mounted in a rear of the machine room 14, which has a spindle 22 and a gear 24 on the spindle 24.

Figure 2:
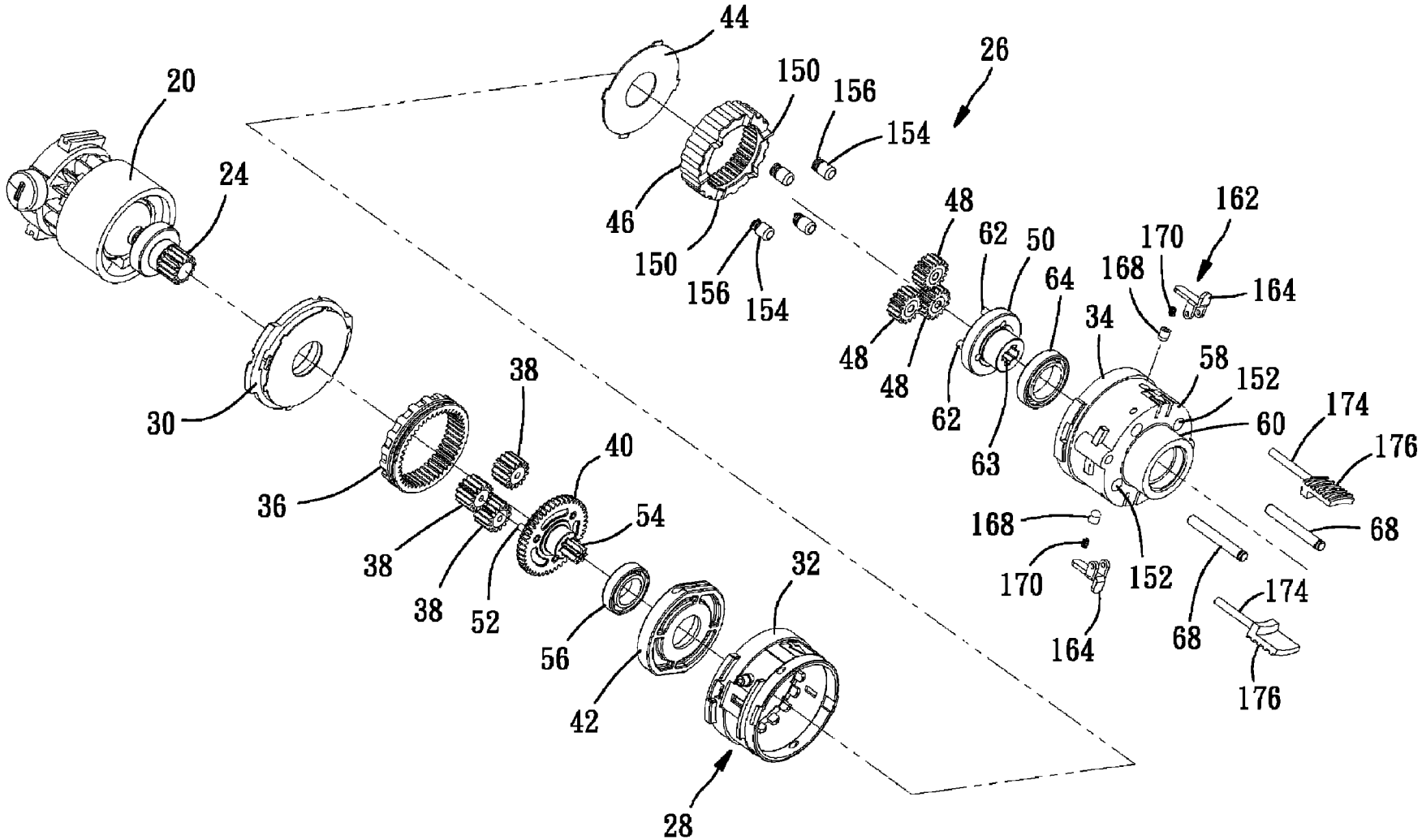
FIG. 2 is an exploded view of the preferred embodiment of the present invention, showing the planetary gear reduction mechanism and the torque adjusting mechanism.

As shown in FIG. 2, the planetary gear reduction mechanism 26 includes a casing 28, in which a speed ring 36, three first planetary gears 38, a first rotary base 40, a support base 42, a pad 44, a torque ring 46, three second planetary gears 48, and a second rotary base 50. The casing 28 consists of a plate 30, a first housing 32, and a second housing 34. The first housing 32 is a tubular member, in which the speed ring 36, the first planetary gears 38, and the first rotary base 40 are received. The speed ring 36 has teeth on an inner side, and the first planetary gears 38 are received in the speed ring 36 to be engaged with the teeth thereof. The spindle 22 of the motor 20 passes through a space within the first planetary gears 38, and the gear 24 engages the first planetary gears 38. The first rotary base 40 has three pins 52 on a side to connect the first planetary gears 38 respectively, and a shaft 54 on the other side. The support base 42, which is received in the first housing 32 at an opposite side, has a hole at a center and a bearing 56 mounted in the hole to be fitted to the shaft 54 of the first rotary base 40. The second housing 34 is open at one end and has an end wall 58 at the other end. The end wall 58 has a cylinder 60 at a center thereof. The open end of the second housing 34 is connected to the first housing 32. In the second housing 34, the torque ring 46, the second planetary gears 48, and the second rotary base 50 are received. The second planetary gears 48 are received in the torque ring 46 and engaged with teeth on an inner side of the torque ring 46. The shaft 54 of the first rotary base 40 passes through a space within the second planetary gears 48 and engages thereto. The second rotary base 50 has three pins 62 on a side connecting the second planetary gears 48 respectively, and a post with a bore 63 therein on the other side. The second housing 34 has a bearing 64 in a hole of the cylinder 60 to connect the post of the second rotary base 50. A speed switch 66 is provided on the housing 10 to control the speed ring 36 of the planetary gear reduction mechanism 26 that planetary gear reduction mechanism 26 may provide two levels of speed. Two bars 68 are provided on the second housing 34.

Figure 3:
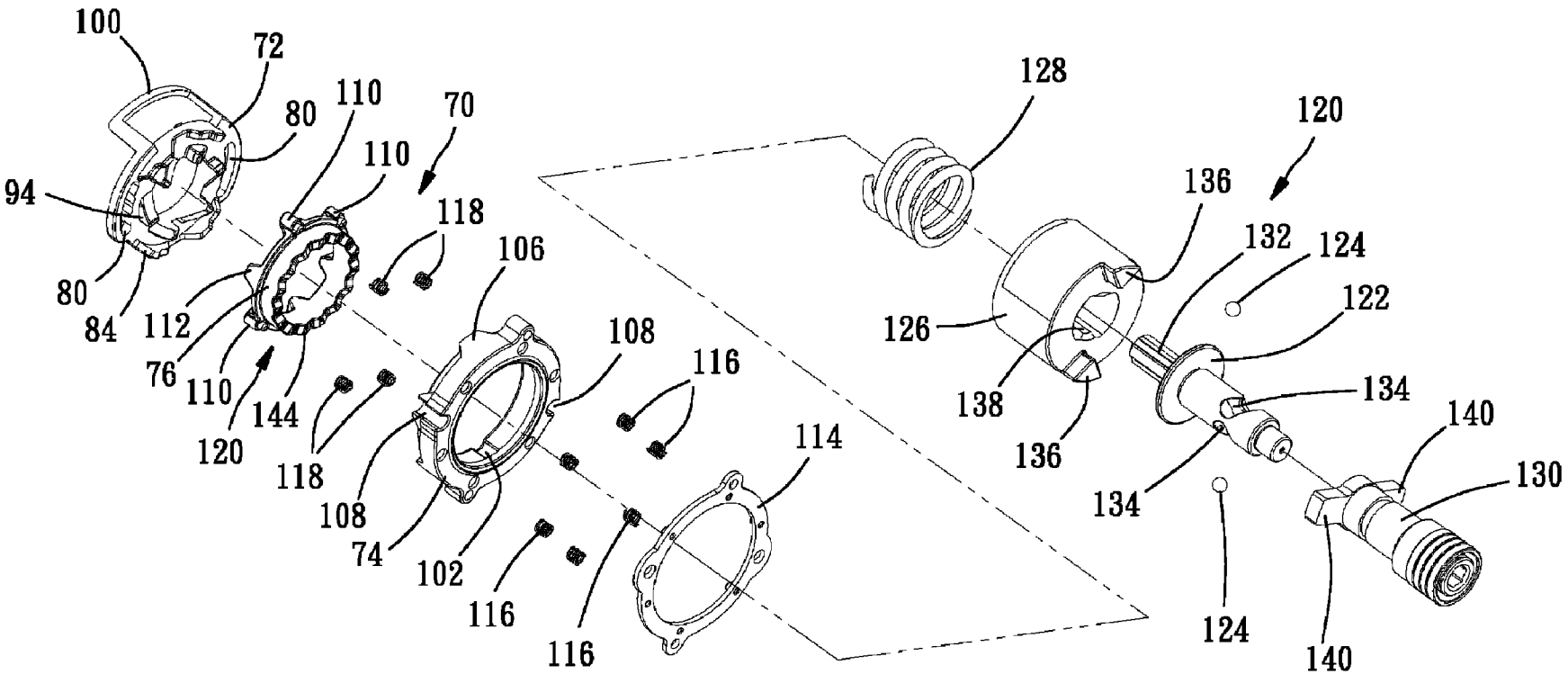
FIG. 3 is an exploded view of the preferred embodiment of the present invention, showing the switch mechanism, the hammer mechanism, and the impact mechanism.
Figure 5:
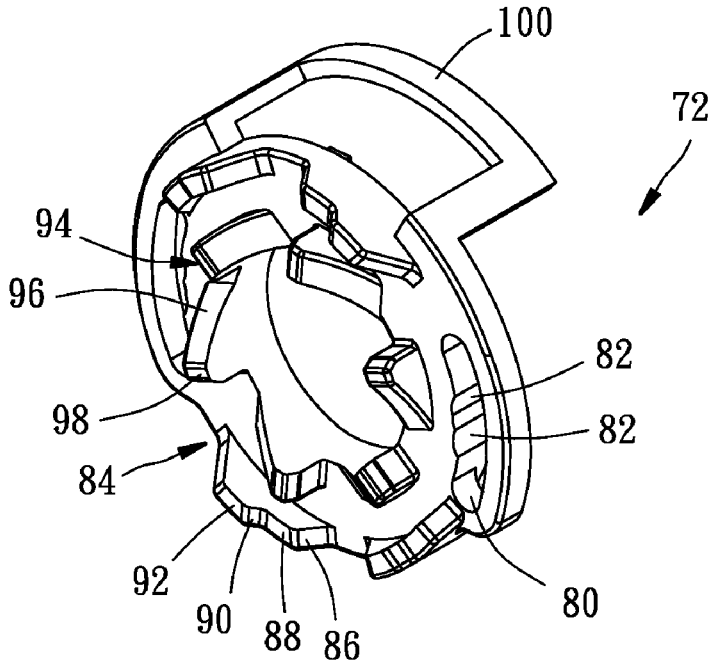
FIG. 5 and FIG. 6 are perspective views of the driving member of the switch mechanism of the preferred embodiment of the present invention.
Figure 6:
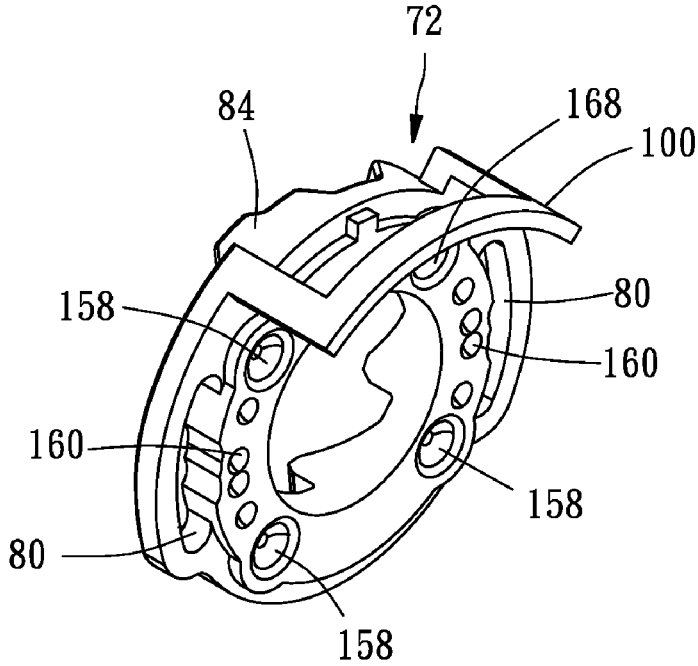
Figure 7:
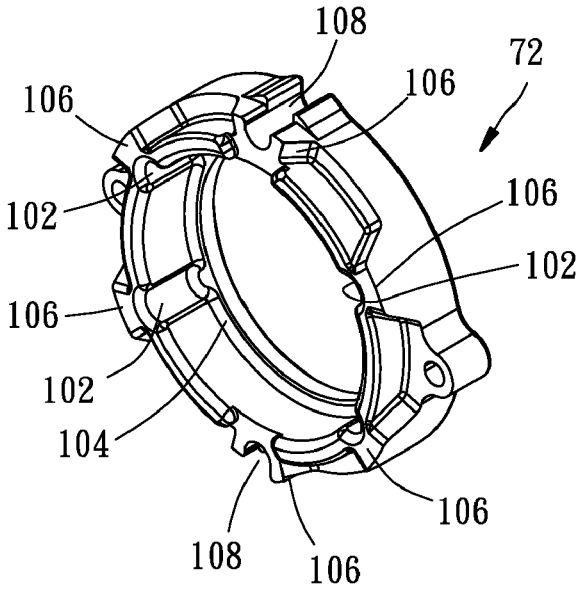
FIG. 7 is a perspective view of the first driven member of the switch mechanism of the preferred embodiment of the present invention.
Figure 8:
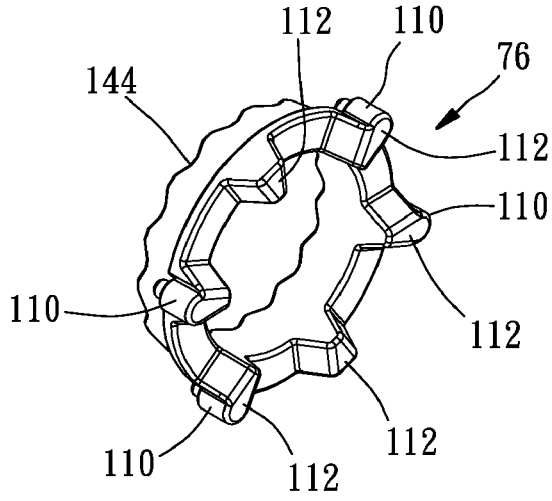
FIG. 8 is a perspective view of the second driven member of the switch mechanism of the preferred embodiment of the present invention.

As shown in FIG. 3, the switch mechanism 70 includes a driving member 72, a first driven member 74, a second driven member 76, and a switching member 78. As shown in FIG. 5 and FIG. 6, the driving member 72 is a disk-like member having a bore at a center, and a connecting portion 100 and two guiding slots 80 at an edge. The connecting portion 100 connects the driving member 72 to the switching member 78, and on a sidewall of each guiding slot 80 has two recesses 82. The driving member 72 has a first driving portion 84 and a second driving portion 86 on a side thereof. The first driving portion 84 and the second driving portion 86 are concentric, and the first driving portion 84 is located at outer side and the second driving portion 86 is located at inner side. The first driving portion 84 has four teeth, each of which has a slope 86, a first level 88, a slope 90, and a second level 92. The second driving portion 94 has six teeth, each of which includes a slope 96 and a top level 98. The bars 68 pass through the guiding slots 80 of the driving member 72 that operating the switching member 78 may rotate the driving member 72 in a preset range. The recesses 82 on the sidewall of the guiding slots 80 locate the driving member 72 at some predetermine positions that the power tool may be switched to different operation modes. As shown in FIG. 7, the first driven member 74 has a central bore, four slots 102 on a sidewall of the central bore, and an annular rim 104 at an end of the central bore. The first driven member 74 is provided with a driven portion 106, which has six teeth, on a side thereof around the central bore, and two recesses 108 on a circumference thereof. The bars 68 are received in the recesses 108 of the first driven member 74 that the driven portion 106 of the first driven member 74 is engaged with the first driving portion 84 of the driving member 72. A diameter of the second driven member 76 is about equal to the second driving portion 94 of the driving member 72. As shown in FIG. 8, the second driven member 76 has a central bore also, and four guiding blocks 110 on a circumference thereof. The second driven member 76 is received in the central bore of the first driven member 74 with the guiding blocks 110 engaged with the slots 102 and stopped by the rim 104. The second driven member 76 is provided with a driven portion 112, which has six teeth, on a side thereof to be engaged with the second driving portion 94 of the driving member 72. The cylinder 60 of the second housing 34 of the planetary gear reduction mechanism 26 is inserted into the central bore of the second driven member 76. A support plate 114 is fixed to distal ends of the bars 68. Six springs 116 are provided between the support plate 114 and the first driven member 74 to urge the first driven member 74, together with the second driven member 76, toward the driving member 72. Between the first driven member 74 and the second driven member 76 is provided with four springs 118 also.

As shown in FIG. 3, the impact mechanism 120 includes a shaft 122, two balls 124, an impact member 126, a spring 128, and a spindle 130. The shaft 122 has teeth adjacent to an end thereof to be inserted through the central bores of the first driven member 74, the second driven member 76 and the driving member 72, and inserted into a bore on the cylinder 60 of the second housing 34 to be engaged with the second planetary gears 48. The shaft 122 is provided with two guiding slots 134. The impact member 126 has a through hole, in which the shaft 122 is received, two blocks 136 on a top thereof, and two guiding recesses 138 on a sidewall of the through hole. The balls 124 are received in the guiding slots 134 of the shaft 122 and the guiding recesses 138 of the impact member 126. The spring 128 is fitted to the shaft 122 with an end urging the impact member 126. The spindle 130, which is connected to an end of the shaft 122 out of the impact member 126, has two arms 140. The impact mechanism 120 as described above is as same as the conventional device that when the spindle 130 is resisted by an external force, the impact member 126 will move backward because of the actions of the balls 124, the guiding slots 134, and the guiding recesses 138, and the arms 140 will cross over the blocks 136 to allow the impact member 126 move forward again because of the spring 128. For a reciprocation of the impact member 126, the impact mechanism 120 may provide the impact effect.

Figure 9:
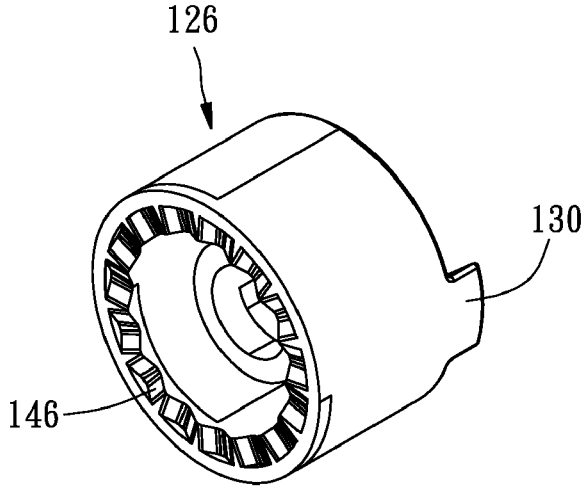
FIG. 9 is a perspective view of the impact member of the impact mechanism of the preferred embodiment of the present invention.

As shown in FIG. 3, the hammer mechanism 142 includes a first teeth ring 144 on a front end the second driven member 76 and a second teeth ring 146 on a rear end of the impact member 126 (as shown in FIG. 9). As the second driven member 76 is driven toward the impact member 126 by the driving member 72, the first teeth ring 144 will engage the second teeth ring 146 that will generate a vibration of hammer effect.

Figure 12:
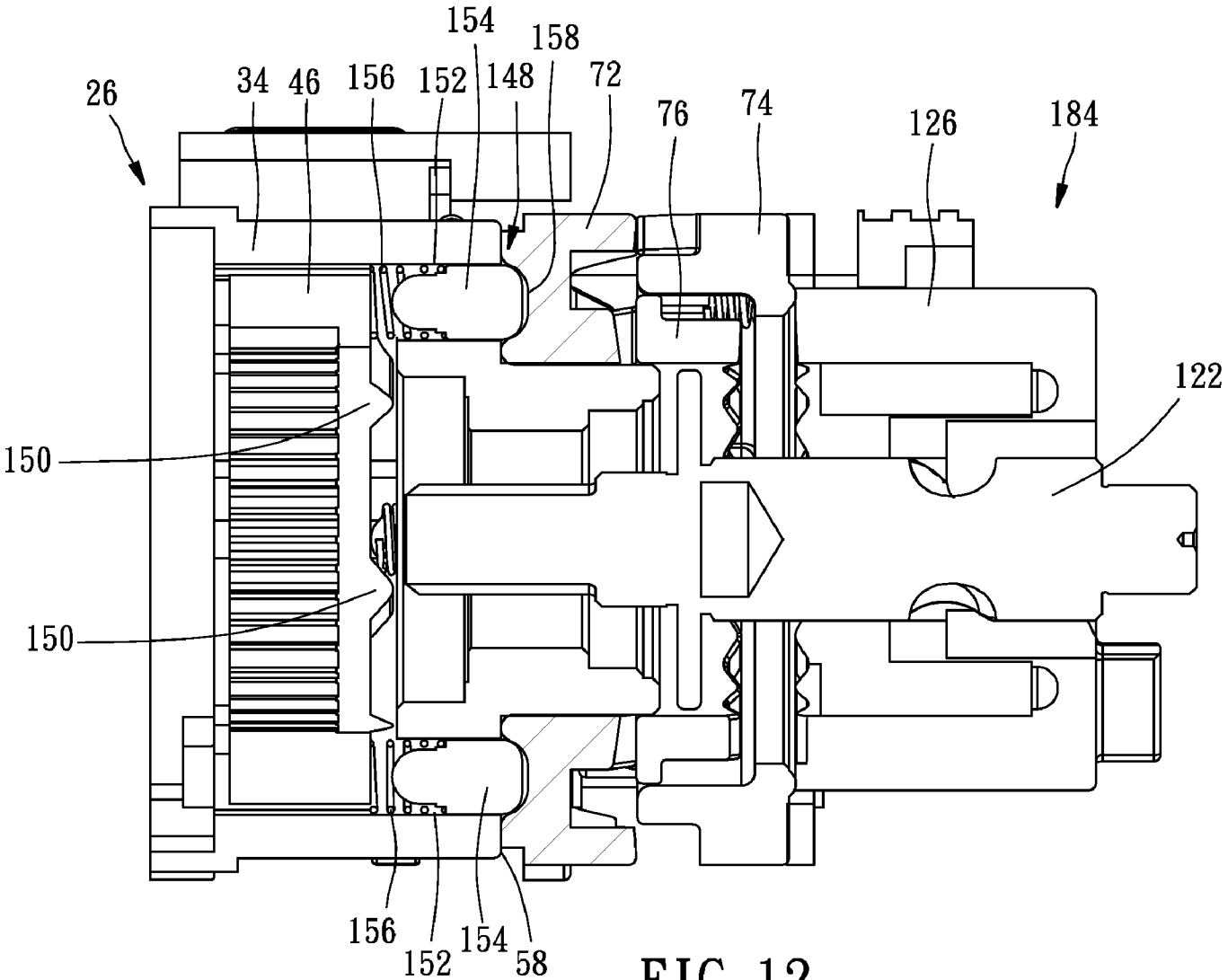
FIG. 12 is a sectional view in part of the preferred embodiment of the present invention, showing the power toll in the driver mode.

As shown in FIG. 2, FIG. 6, and FIG. 12, the torque fixing mechanism includes six teeth 150 on a front annular end of the torque ring 46. The second housing 34 is provided with four bores 152 on the end wall 58 thereof. In each of the bores 152, a pin 154 and a spring 156 are mounted. The pin 154 has inner ends aligned with the front annular end of the torque ring 46 and outer ends left out of the second housing 34. The driving member 72 is provided with four recesses 158 on a side opposite to the driving portions 84, 86, and four position portions 160, which are shallower recesses, between each of the neighboring two recesses 158. When the driving member 72 is turned to a specific operation mode other than the driver mode, the outer ends of the pins 154 will enter the specific position portions 160, and the driving member 72 will press the pins 154 to have the inner ends thereof pressing the front annular end of the torque ring 46 and stopped by the teeth 150 that the torque ring 46 is fixed and the planetary gear reduction mechanism 26 outputs a maximum power. When the driving member 72 is turned to a position where the pins 154 enter the recesses 158, the pin will no longer press the torque ring 46, and the torque ring 46 is free to rotate that the planetary gear reduction mechanism 26 outputs a minimum power.

Figure 13:
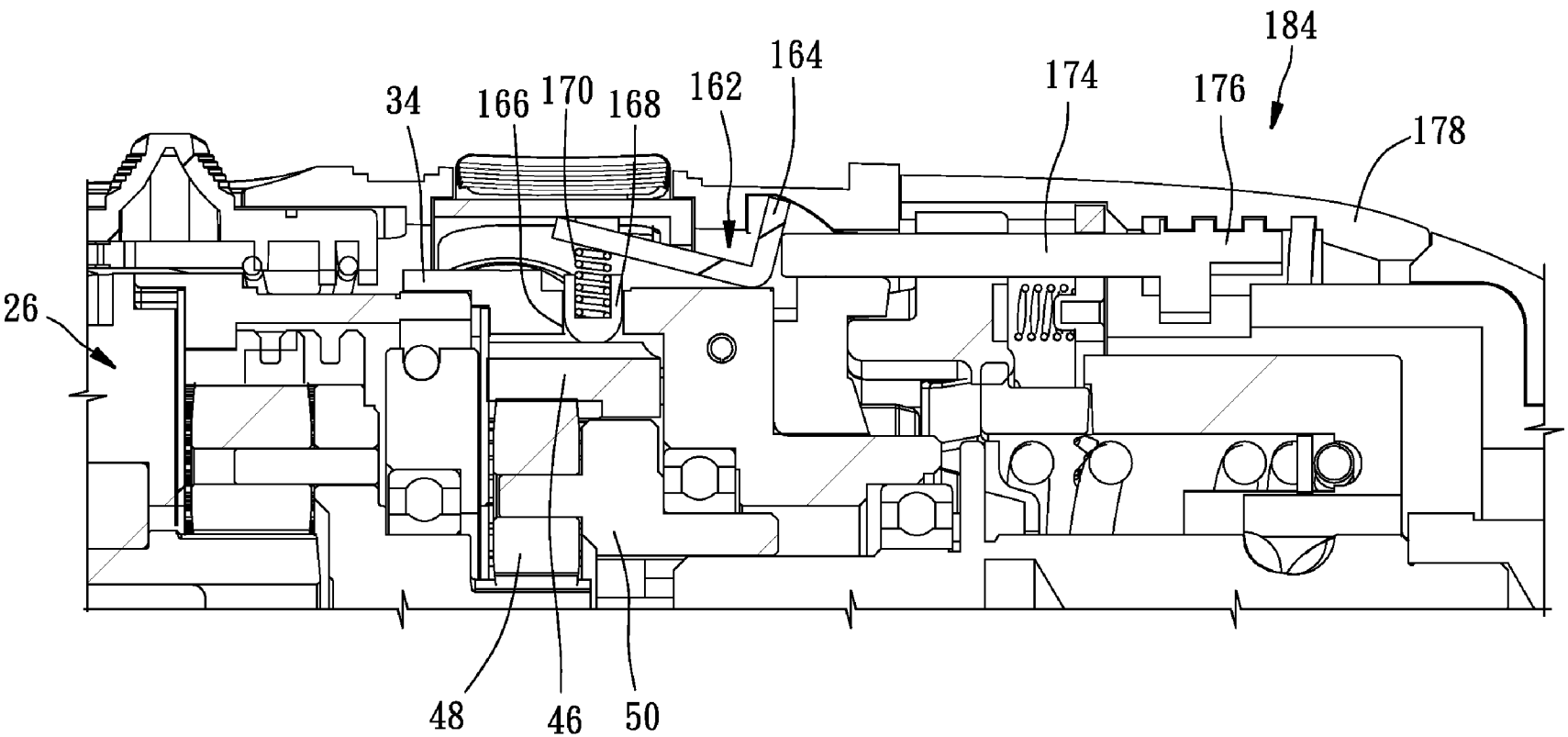
FIG. 13 is a sectional view in part of the preferred embodiment of the present invention, showing the action of the torque adjusting mechanism in the driver mode.

As shown in FIG. 3 and FIG. 13, the torque adjusting mechanism 162 includes two levers 164 provided on the second housing 34 and pins 168 and springs 170 mounted in two bores 166 of the second housing 34. The torque ring 46 has teeth 172 on a circumference thereof. The levers 164 may move the pins 168 downward to press the torque ring 46. Two posts 174 pass through the support plate 114 and the first driven member 74 and touch ends of the levers 164 respectively. Each post 174 is provided with a teethed piece 176 on the other end. A wheel 178 is pivoted on the front of the machine room 14, which has teeth 178 on an inner side engaged with the teethed pieces 176 that turn of the wheel 178 may move the posts 174, and the posts 174 will tilt the levers 174 to move the pins 168 downward. The wheel 178 may adjust the pressure of the pins 168 on the torque ring 46 to adjust the torque output.

Figure 10:
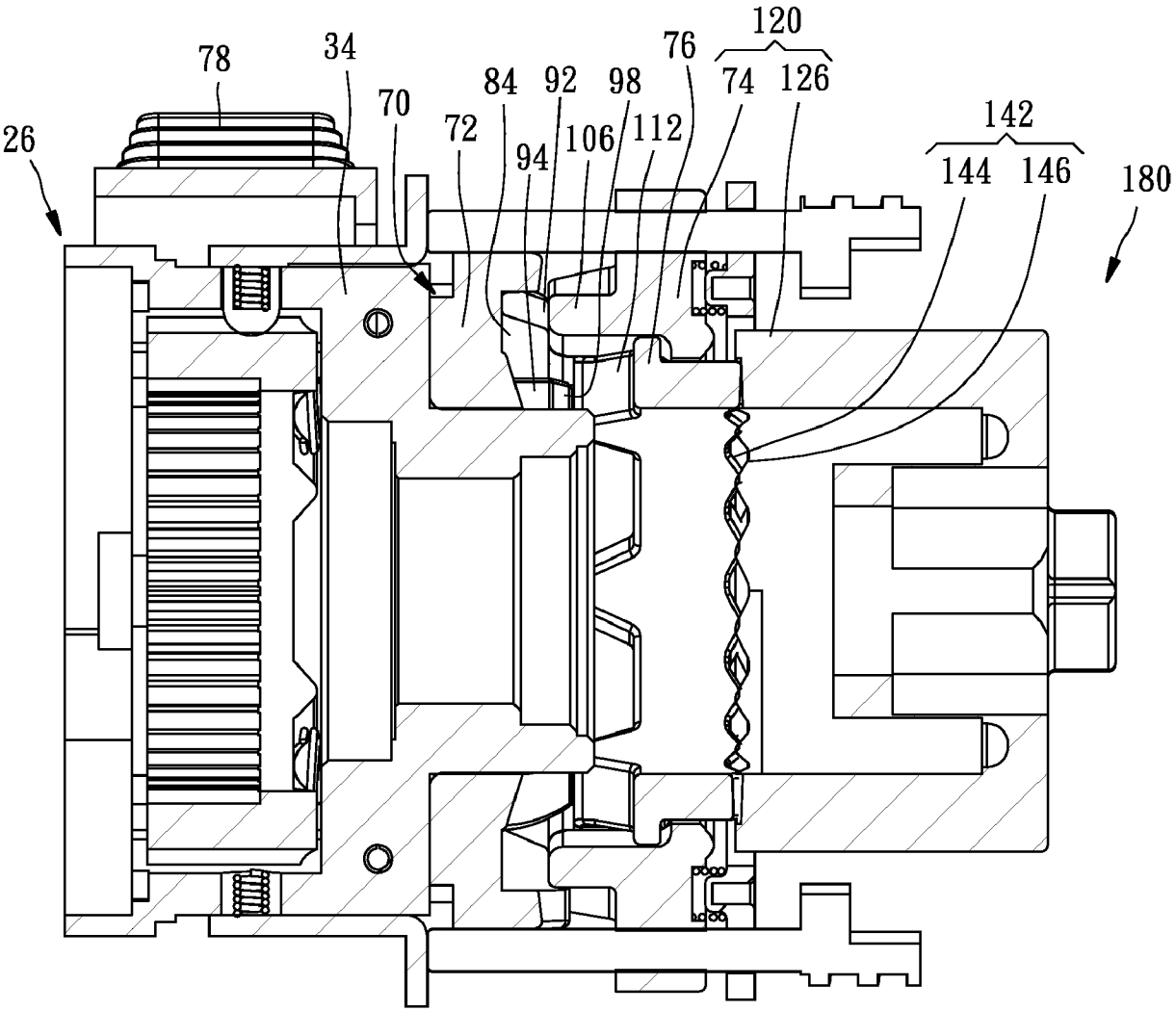
FIG. 10 is a sectional view in part of the preferred embodiment of the present invention, showing the power toll in the hammer mode.

As shown in FIG. 1, the housing 10 is provided with four icons beside the switching member 78, which represents, from left to right, hammer mode 180, drill mode 182, driver mode 184, and impact mode 186. When one operates the switching member 78 to the hammer mode 180, as shown in FIG. 10, the first driving portion 84 of the driving member 72 has the first level 88 touching the driven portion 106 of the first driven member 74 to move the first driven member 74 toward the impact member 126. In the mean time, the second driving portion 94 of the driving member 72 has the top level 98 touching the driven portion 112 of the second driven member 76 to move the second driven member 76 toward the impact member 126 and to engage the first teeth ring 144 on the second driven member 76 with the second teeth ring 146 on the impact member 126. In such condition, the impact member 126 is stopped by the first driven member 74 so that the impact mechanism 120 is shut, and the first teeth ring 144 and the second teeth ring 146 are engaged so that the hammer mechanism 142 is started. As a result, the spindle 130 is vibrated to have the hammer effect.

Figure 11:
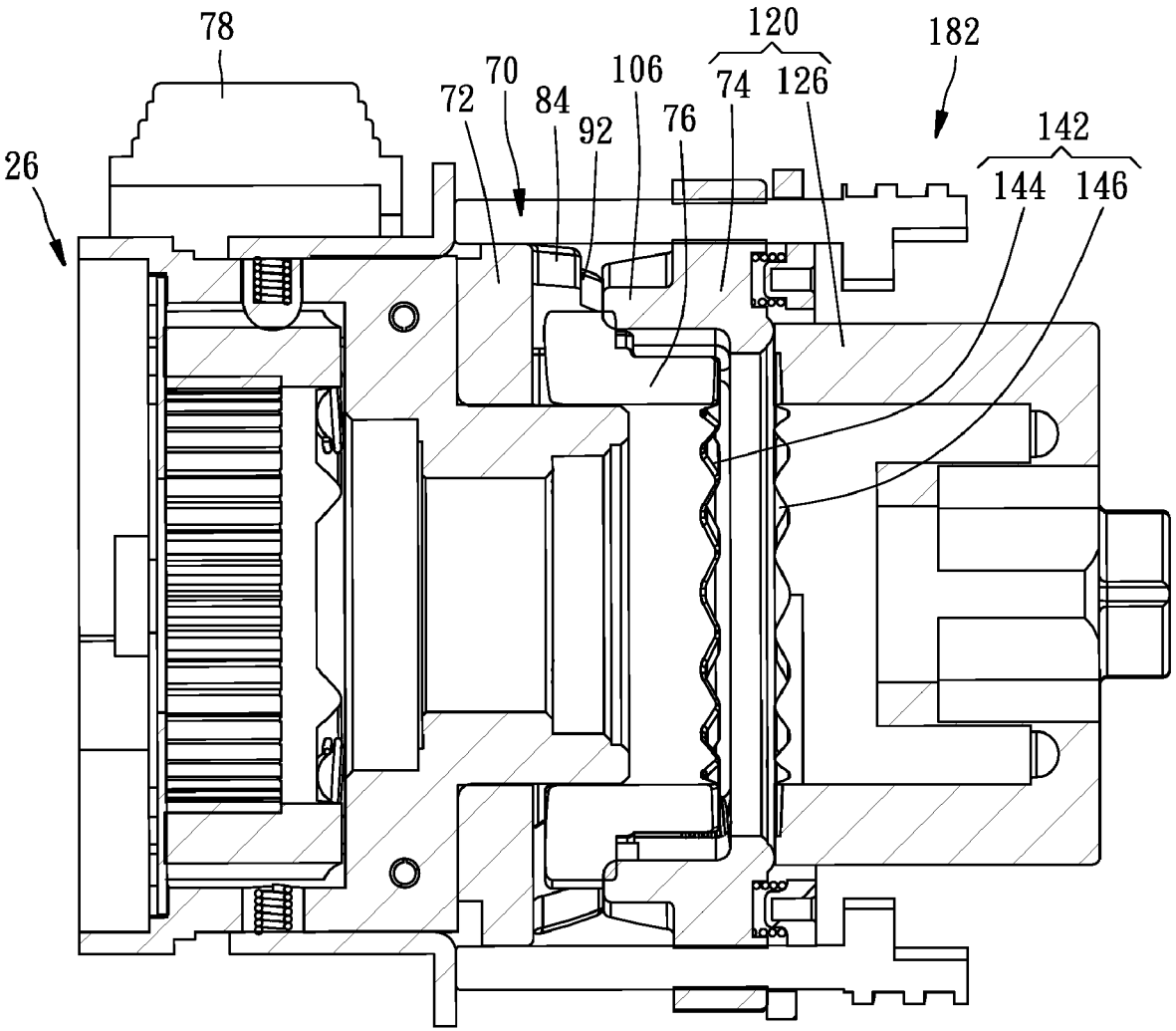
FIG. 11 is a sectional view in part of the preferred embodiment of the present invention, showing the power toll in the drill mode.

Next, when the switching member 78 is switched to the drill mode 182, as shown in FIG. 11, the first driving portion 84 of the driving member 72 has the second level 92 touching the driven portion 106 of the first driven member 74 to move the first driven member 74 toward the impact member 126. In the mean time, the top levels 98 of the second driving portion 94 of the driving member 72 leave the driven portion 112 of the second driven member 76 to move the second driven member 76 backward and to disengage the first teeth ring 144 with the second teeth ring 146. In such condition, the impact member 126 is still stopped by the first driven member 74 so that the impact mechanism 120 is shut, and the first teeth ring 144 and the second teeth ring 146 are disengaged so that the hammer mechanism 142 is shut also. As a result, the spindle 130 is simply rotating to have the drill effect.

It has to be mentioned that, in the drill mode 812, the impact mode 180, and the hammer mode 186, the pins 154 of the torque fixing mechanism 148 are received in the position portions 160 of the driving member 72 that the pins 154 will press the teeth 510 of the torque ring 46. As a result, the motor 20 has a maximum torque output. While the switching member 78 is switched to the driver mode 184, as shown in FIG. 12, the driving member 72 has the second level 92 of the first driving portion 84 touching the driven portion 106 of the driven member 74, and the slope 96 of the second driving portion 94 touching the driven portion 112 of the second driven member 76. In such condition, both of the impact mechanism 120 and the hammer mechanism 142 are shut. Besides, the recesses 158 of the driving member 72 are moved to positions behind the pins 154 that the pins 154 are no longer pressing the torque ring 46, and the torque ring 46 are free to rotate. In such condition, the torque output is minimum. In the driver mode 184, as shown in FIG. 13, one may turn the wheel 178 on the housing 10 to move the posts 174 and tilt the levers 164. The tilting angles of the levers 164 will affect the pressure of the pins 168 pressing the torque ring 46 that may adjust the torque output.

Figure 14:
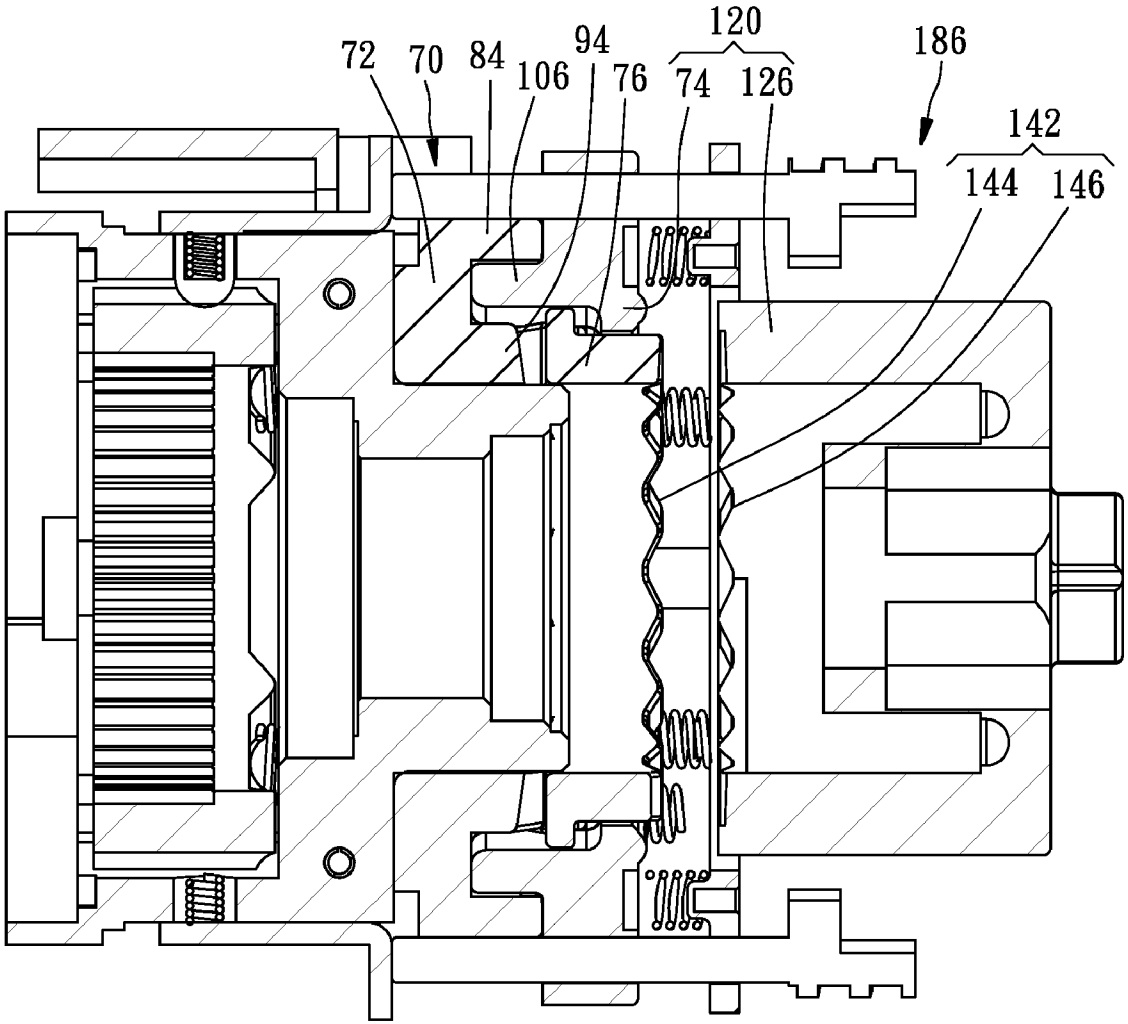
FIG. 14 is a sectional view in part of the preferred embodiment of the present invention, showing the power toll in the impact mode.

As shown in FIG. 14, when the switching member 78 is switched to the impact mode 186, the teeth of the first driving portion 84 of the driving member 72 leave the driven portion 106 of the first driven member 74 to move the first driven member 74 away from the impact member 126 that there is a sufficient space behind the impact member 126, and the impact mechanism 120 is started. In the mean time, the second driving portion 94 of the driving member 72 leave the driven portion 112 of the second driven member 76 to move the second driven member 76 away from the impact member 126 to disengage the first teeth ring 144 with the second teeth ring 146 that the hammer mechanism 142 is shut. In the impact mode 186, the impact member 126 of the impact mechanism 120 is reciprocating to provide the impact effect.

The main characters of the present invention include switching hammer mode, drill mode, driver mode, and the impact mode only by the switching member. Besides, the second teeth ring 146 of the hammer mechanism 142 is provided on the rear end of the impact member 126 of the impact mechanism 120, and the first teeth ring 146 is provided on the second driven member 76 that the driving member 72 may directly control the second driven member 76 to start or shut the hammer mechanism 142 without the complex control mechanism in the conventional device. The extra advantage of above is that there is one element less in the present invention because the second teeth ring 146 is provided on the rear end of the impact member 126. Therefore, the length of the present invention may be shortened. The least character of the present invention is that we use the front end side of the toque ring 46 to be the position of controlling the start or shut of the torque adjustment, and the circumference of the torque ring 46 to be the position of adjusting the torque. The separated control positions on the torque ring make the torque adjustment more precisely.

What is claimed is:

1. An electric power tool comprising:

a switching member provided on a housing of the electric power tool for manipulation;

a driving member, which is connected to the switching member to be turned in a predetermined angle, having a first driving portion and a second driving portion on a side, the first driving portion and the second driving portion of the driving member having teeth on two concentric circles;

a first driven member having a driven portion, the driven portion of the first driven member having circular teeth directly engaged with the first driving portion of the driving member that a turn of the driving member moves the first driven member;

a second driven member having a driven portion, the driven portion of the second driven member having circular teeth directly engaged with the second driving portion of the driving member that a turn of the driving member moves the second driven member;

an impact mechanism having an impact member for reciprocation, wherein the first driven member is located behind the impact member; and a hammer mechanism having a first teeth ring and a second teeth ring, wherein the first teeth ring is provided on the second driven member, and the second teeth ring is connected to a spindle of the electric power tool;

wherein the switching member is switchable to an impact mode, a hammer mode, and a drill mode, and when the switching member is switched to the impact mode, the driving member moves the first driven member away from the impact member to start the impact mechanism, and the driving member also move the second driven member to disengage the first teeth ring with the second teeth ring to shut the hammer mechanism;

wherein when the switching member is switched to the hammer mode, the driving member moves the first driven member toward the impact member to shut the impact mechanism, and the driving member also move the second driven member to engage the first teeth ring with the second teeth ring to start the hammer mechanism;

wherein when the switching member is switched to the drill mode, the driving member moves the first driven member toward the impact member to shut the impact mechanism, and the driving member also move the second driven member to disengage the first teeth ring with the second teeth ring to shut the hammer mechanism; and wherein the first driving portion and the second driving portion of the driving member have teeth on two concentric circles, and the driven portion of the first driven member and the second teeth member have circular teeth.

2. The electric power tool as defined in claim 1, wherein the first driving portion of the driving member has teeth, each of which has a first level and a second level higher than the first level, and the driven portion of the first driven member has teeth, and wherein when the teeth of the driven portion of the first driven member touch the first levels or the second levels of the first driving portion of the driving member, the impact mechanism is shut.

3. The electric power tool as defined in claim 1, wherein the second driving portion of the driving member has teeth, each of which has a top level and a slope, and the driven portion of the first driven member has teeth, and wherein when the teeth of the driven portion of the second driven member touch the top levels of the second driving portion of the driving member, the hammer mechanism is shut.

4. The electric power tool as defined in claim 1, wherein the first driven member has a central bore, in which the second driven member is received.

5. The electric power tool as defined in claim 4, wherein the first driven member is provided with slots on a sidewall of the central bore, and the second driven member has guiding bloke received in the slots of the first driven member respectively.

6. The electric power tool as defined in claim 4, wherein the first driven member has an annular rim at an end of the central bore to stop the second driven member.

7. The electric power tool as defined in claim 4, wherein an end of the second driven member is moved out of the first driven member by the driving member when the switching member is switched to the hammer mode.

8. The electric power tool as defined in claim 1, wherein the first teeth ring of the hammer mechanism is provided on the impact member of the impact mechanism.

9. An electric power tool comprising:

a switching member provided on a housing of the electric power tool for manipulation;

a driving member, which is connected to the switching member to be turned in a predetermined angle, having a first driving portion and a second driving portion on a side;

a first driven member having a driven portion directly engaged with the first driving portion of the driving member that a turn of the driving member moves the first driven member;

a second driven member having a driven portion directly engaged with the second driving portion of the driving member that a turn of the driving member moves the second driven member;

an impact mechanism having an impact member for reciprocation, wherein the first driven member is located behind the impact member; and a hammer mechanism having a first teeth ring and a second teeth ring, wherein the first teeth ring is provided on the second driven member, and the second teeth ring is connected to a spindle of the electric power tool;

wherein the switching member is switchable to an impact mode, a hammer mode, and a drill mode, and when the switching member is switched to the impact mode, the driving member moves the first driven member away from the impact member to start the impact mechanism, and the driving member also move the second driven member to disengage the first teeth ring with the second teeth ring to shut the hammer mechanism;

wherein when the switching member is switched to the hammer mode, the driving member moves the first driven member toward the impact member to shut the impact mechanism, and the driving member also move the second driven member to engage the first teeth ring with the second teeth ring to start the hammer mechanism;

wherein when the switching member is switched to the drill mode, the driving member moves the first driven member toward the impact member to shut the impact mechanism, and the driving member also move the second driven member to disengage the first teeth ring with the second teeth ring to shut the hammer mechanism; and wherein the driving portion is provided with position positions on a side opposite to the first driving portion and the second driving portion.

10. An electric power tool comprising:

a switching member provided on a housing of the electric power tool for manipulation;

a driving member, which is connected to the switching member to be turned in a predetermined angle, having a first driving portion and a second driving portion on a side;

a first driven member having a driven portion directly engaged with the first driving portion of the driving member that a turn of the driving member moves the first driven member;

a second driven member having a driven portion directly engaged with the second driving portion of the driving member that a turn of the driving member moves the second driven member;

an impact mechanism having an impact member for reciprocation, wherein the first driven member is located behind the impact member; and a hammer mechanism having a first teeth ring and a second teeth ring, wherein the first teeth ring is provided on the second driven member, and the second teeth ring is connected to a spindle of the electric power tool;

wherein the switching member is switchable to an impact mode, a hammer mode, and a drill mode, and when the switching member is switched to the impact mode, the driving member moves the first driven member away from the impact member to start the impact mechanism, and the driving member also move the second driven member to disengage the first teeth ring with the second teeth ring to shut the hammer mechanism;

wherein when the switching member is switched to the hammer mode, the driving member moves the first driven member toward the impact member to shut the impact mechanism, and the driving member also move the second driven member to engage the first teeth ring with the second teeth ring to start the hammer mechanism;

wherein when the switching member is switched to the drill mode, the driving member moves the first driven member toward the impact member to shut the impact mechanism, and the driving member also move the second driven member to disengage the first teeth ring with the second teeth ring to shut the hammer mechanism; and further comprising two bars passing through guiding slots of the driving member that the driving member is limited to turn in the predetermined angle.

11. The electric power tool as defined in claim 10, wherein the driving member is provided with recesses on sidewalls of the guiding slots.

12. The electric power tool as defined in claim 10, wherein the first driven member has two recesses to receive the bars therein, and the first driven member is moved along the bars.

13. The electric power tool as defined in claim 10, further comprising a support plate fixed to distal ends of the bars, and springs between the support plate and the first driven member.

* * * * *